US008011545B2

(12) United States Patent
Murdoch et al.

(10) Patent No.: US 8,011,545 B2
(45) Date of Patent: Sep. 6, 2011

(54) CARRIER SYSTEM

(75) Inventors: Douglas Harland Murdoch, Santa Rosa, CA (US); Michael Sturm, Redding, CA (US)

(73) Assignee: Think Tank Photo, Inc., Santa Rosa, CA (US)

( * ) Notice: Subject to any disclaimer, the term of this patent is extended or adjusted under 35 U.S.C. 154(b) by 436 days.

(21) Appl. No.: 12/095,997

(22) PCT Filed: Nov. 29, 2006

(86) PCT No.: PCT/US2006/061357

§ 371 (c)(1),
(2), (4) Date: Jun. 3, 2008

(87) PCT Pub. No.: WO2007/067861

PCT Pub. Date: Jun. 14, 2007

(65) Prior Publication Data

US 2008/0296327 A1 Dec. 4, 2008

Related U.S. Application Data

(60) Provisional application No. 60/742,294, filed on Dec. 5, 2005.

(51) Int. Cl.
*A45F 5/00* (2006.01)

(52) U.S. Cl. ..... 224/672; 224/675

(58) Field of Classification Search ..... 224/672, 224/675, 660, 667, 223, 930, 271, 272, 269, 224/195, 666, 665; 24/3.7; 2/312, 318, 319
See application file for complete search history.

(56) References Cited

U.S. PATENT DOCUMENTS

| | | | | |
|---|---|---|---|---|
| 4,676,419 | A * | 6/1987 | Victor | 224/649 |
| 4,747,527 | A * | 5/1988 | Trumpower, II | 224/662 |
| 5,470,000 | A * | 11/1995 | Munoz | 224/665 |
| 5,724,707 | A * | 3/1998 | Kirk et al. | 24/3.7 |
| 6,431,424 | B1 * | 8/2002 | Smith | 224/583 |
| 7,770,770 | B2 * | 8/2010 | Murdoch et al. | 224/672 |
| 2003/0000986 | A1 | 1/2003 | Smith | |

OTHER PUBLICATIONS

Extended European Search Report dated Apr. 1, 2011 for European patent application 05800955.6-1258 (regional phase filing of PCT/US2005/034036).

* cited by examiner

*Primary Examiner* — Justin Larson
(74) *Attorney, Agent, or Firm* — R. Dabney Eastham

(57) ABSTRACT

A system for carrying articles from a belt worn on the body of a person or other animate bearer comprises a belt or elongated member (20) with a substantially planar rail (30) borne on the outside surface of the belt and a carrier (50) for articles attached to the rail by a sleeve sewn to the body of the carrier. The carrier (50) may be free to slide along the rail (30) or may be secured at least temporarily to the rail. The carrier (50) thereby can be moved along the rail when worn on the belt so that the bearer can place the carrier (50) in a more comfortable or useful position with respect to the body of the bearer and secure it in that position at least temporarily.

12 Claims, 7 Drawing Sheets

CARRIER SYSTEM

CROSS-REFERENCE TO RELATED APPLICATIONS

This application claims the benefit of U.S. provisional patent application Ser. No. 60/742,294, filed on Dec. 5, 2005 for a "Carrier System," by Douglas Harland Murdoch and Michael Sturm, and assigned to Think Tank Photo, Inc., the disclosure of which is incorporated by reference as if fully disclosed herein to the full extent permitted by treaty, law, and regulation.

STATEMENT REGARDING FEDERALLY SPONSORED RESEARCH OR DEVELOPMENT

Not applicable.

FIELD OF THE DISCLOSURE

The field of this disclosure is that of article carriers supported by an animate bearer, such as a human being.

BACKGROUND

Human beings have long carried articles by attaching them to belts worn around the waist or hips. Such objects have included canteens, weapons, food carriers, and the like. In modern times, for example, photographers may carry cameras, lens systems such as telephoto lens systems, and other photographic gear in pouches or carriers suspended from a belt worn about the waist or hips.

An article to be carried by a belt may be permanently or releaseably attached to a definite position on the belt. Alternatively, the article may be attached to the belt by a sleeve or the like so that the article may be moved along the belt as needed in order to access the article or to wear it in the most comfortable position.

A belt carrier system that provides for both types of attachment at the choice of the wearer is needed.

U.S. Pat. No. 5,881,933 to Rogers, entitled "Track Member System" discloses a system for carrying containers suspended from a track member which may be attached to a body encircling belt or attached to clothing which includes a pair of protruding tracks substantially parallel and from which the containers for holding articles are suspended by clips on the containers which are attachable to the tracks anywhere along the lengths thereof or positionable lengthwise on the tracks by sliding thereon at tapered ends of the tracks. This system includes a clamp in the form of a planar wedge for locking the container in place on the tracks to prevent the container from sliding along the tracks to an undesired position and inhibiting forceful unintended removal of the clip and container from the tracks without removal of the clamp.

The track member system of Rogers is complicated and expensive to make because its construction requires the provision of two parallel and protruding members and a rigid clip attached to a carrier that is specifically shaped to receive the parallel members and thereby hold the carrier on the belt. The security of the attachment of the clip to the carrier depends on how well the clip encloses the members so that failure of that enclosure will cause detachment of the carrier from the belt. In addition, the planar wedge clamp is complicated and requires the provision of additional components.

One of the inventors of the present invention, Douglas H. Murdoch, has previously filed provisional application no. U.S. 60/611,655 for a "Carrier System" (Patent Coordination Treaty application PCT/US2005/34036 filed on Sep. 20, 2005 and published as WO 2006/034421 claims priority from this provisional application) directed to, generally, a system comprising an elongated planar member or belt to be worn by an animate bearer such as a human being having an outside surface facing away from the bearer's body and an inside surface facing toward the body of the bearer, at least one loop or pocket attached to the outside surface of the belt, and at least one carrier for an object comprising a sleeve having a first end attached to a body of the carrier and a second end detachably attached to the body of the carrier, the first end and the second end of the sleeve being spaced apart at their respective places of attachment to the body of the carrier so that the second end of the sleeve can be folded over the belt and attached to the body of the carrier, and further comprising a tab of stiff material having a first end attached to the carrier at or near the junction of the first end of the sleeve to the carrier and a second end remaining unattached, the tab having an axis generally aligned with the sleeve, the second end of the tab being capable of being inserted through one of the loops of the belt when the sleeve is folded over the belt for attachment of the carrier to the belt and thereby fixing the carrier with respect to the belt so that the carrier substantially may not be slid along the belt whereas if the tab is not inserted into a loop when the sleeve is folded over the belt the carrier is not substantially fixed with respect to the belt and therefore may be slid along the belt. (The disclosures of provisional application no. U.S. 60/611,655 and PCT application PCT/US2005/34036 published as WO 20061034421 are incorporated by reference as if fully disclosed herein to the full extent permitted by treaty, law, and regulation.) In this configuration the sleeve is generally placed between the belt and the body of the wearer. This may require the wearer to either loosen the belt or suck in her breath in order to remove the sleeve from the belt or to slide the carrier with respect to the belt.

What is needed for is an improved carrier system that provides for attaching articles to a belt that provides for the articles to be releaseably attached at a fixed position on the belt or, in the alternative, to be in a slideable relation to the belt.

SUMMARY OF THE DISCLOSURE

The present disclosure provides, in one aspect, a carrier system comprising a belt comprising an elongated member to be worn by an animate bearer such as a human being and having an outside surface facing away from the bearer's body and an inside surface facing toward the body of the bearer, and a substantially planar rail supported by and spaced from the elongated member. In various embodiments, the rail may be attached to the outer surface of the member and spaced from the outer surface of the member at points where the rail is not attached to the member. The rail may have two spaced apart ends and at least one end is attached to the outer surface of the elongated member. The rail may have a center and the center of the rail may be attached to the outer surface of the elongated member. The elongated member may comprise a substantially planar stiffener. The rail may have two spaced apart ends and each of the ends may be attached to the outer surface of the elongated member and a center of the rail may be attached to a center of the elongated member so that the rail has right and left portions spaced from the outer surface of the elongated member. The rail may be shaped like a "V" with a generally obtuse angle and may be concave upwards when mounted on the outer surface of the elongated member. The rail may be attached at a center of the rail to a center of the elongated member so that the rail has right and left portions spaced from the outer surface of the elongated member and the right and left portions are joined at the generally obtuse angle. The elongated member may have two spaced-apart ends and the belt further comprises a buckle for joining the two ends. The carrier system may further comprise at least one carrier for an article, the carrier comprising a body and a sleeve connected to the body of the carrier for detachably securing the carrier to the rail. The sleeve may further comprise a first end attached to the body of the carrier and a second end with means for detachable attachment to the body of the carrier, the first end and the second end of the sleeve being spaced apart at their respective places of attachment to the body of the carrier so that the second end of the sleeve can be folded over the rail and attached to the body of the carrier. The carrier may further comprise a tab made of stiff material having a first end attached to the body of the carrier at or near the junction of the first end of the sleeve to the body of the carrier and a second end remaining unattached, the tab having an axis generally aligned with the sleeve, wherein the second end of the tab is adapted to be capable of being inserted through a loop attached to the rail when the sleeve is folded over the rail for attachment of the carrier to the rail and thereby fixing the carrier with respect to the rail so that the carrier substantially may not be slid along the rail whereas if the tab is not inserted into the loop when the sleeve is folded over the rail the carrier is not substantially fixed with respect to the rail and may be slid along the rail. The tab may be long enough that the second end of the tab is adjacent the means of detachable attachment of the second end of the sleeve when the carrier for articles is supported by the rail.

Without limitation, it is an object and advantage of the present invention to provide to provide an improved system for carrying equipment on the wearer.

Another object and advantage is to provide a system for carrying equipment on the wearer that will positively attach the equipment to a member supported by the wearer so that the equipment will not become accidentally detached.

Another object and advantage is to provide an improved system that will positively attach equipment to the wearer that will permit the equipment to be moved with respect to the member worn by the wearer while the equipment is supported by that member but alternatively, at the option of the wearer, to permit the equipment to be carried in a fixed relationship to the member.

Another object and advantage is to provide a system for carrying equipment on a wearer that is simple and inexpensive to manufacture.

REFERENCE NUMERALS IN THE DRAWINGS

Figure 1:
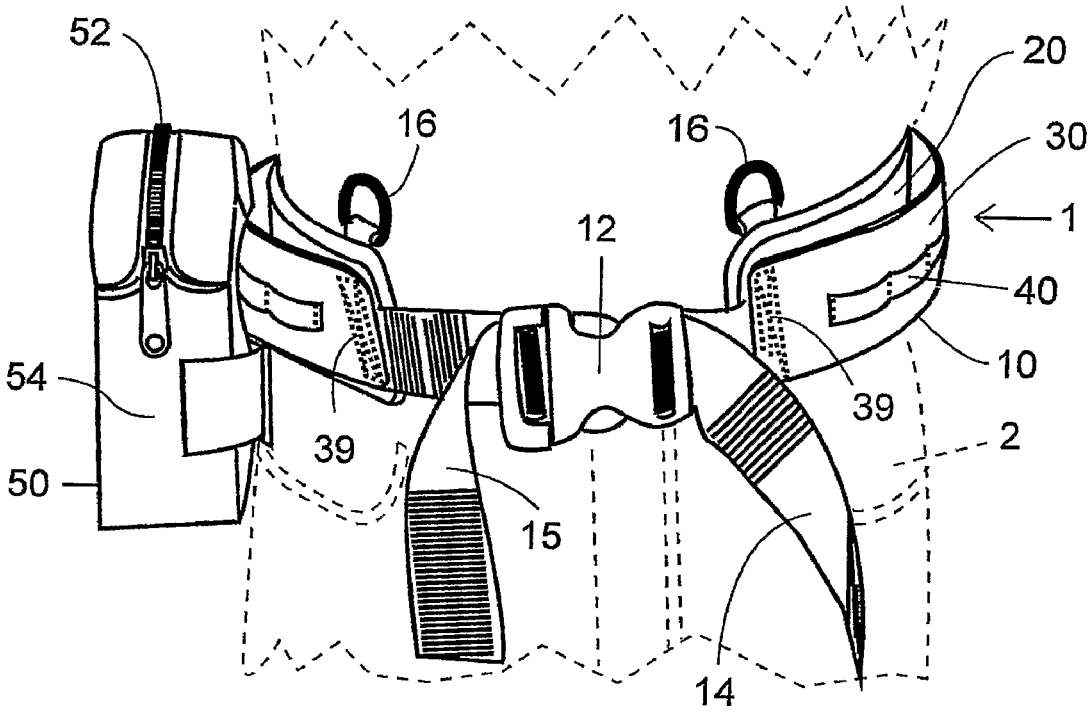
FIG. 1 is a perspective view of a preferred embodiment of the waist belt carrier system according to the invention shown being worn around the waist of a person.

1 waist belt carrier system
2 person
10 belt
12 buckle
12A first half of buckle
12B second half of buckle
14 first webbing
15 second webbing
16 D-ring for attachment to harness system
17 rectangular ring for attachment to harness system
20 body-contacting portion of belt
21 PE board stiffener for body-contacting portion of belt
22 fabric tube
23 foam padding
24A upper longitudinal stitching line
24B lower longitudinal stitching line
25A upper transverse stitching line
25B lower transverse stitching line
26 outside surface of body-contacting portion of belt
28 inside surface of body-contacting portion of belt
29 fabric cover and keeper for PE board stiffener for body-contacting portion of belt
30 rail
32 fabric tube
34 stitch line
36 PE board stiffener
38 center stitch connection
39 edge stitch connection
40 webbing
42 bar tack
44 loop
50 carrier for objects
52 zipper
54 body of carrier
60 sleeve
62 first end of sleeve
64 second end of sleeve
66 loop strip
68 hook strip
70 tab
72 first end of tab
74 second end of tab

DETAILED DESCRIPTION OF THE PREFERRED EMBODIMENTS

Referring now to the drawings, an animate bearer (in this case a person) 2 wearing about his waist a preferred embodiment of a carrier system according to the invention 1 is shown in FIG. 1. The carrier system 1 is comprised of a belt 10 attached to a carrier for articles 50.

The belt 10 comprises a body contacting portion 20 of the belt in the form of an elongated planar member having an outside surface 26 of the body-contacting portion of the belt 20 that faces away from the bearer's body and an inside surface 28 of the body-contacting portion 20 of the belt 10

Figure 3:
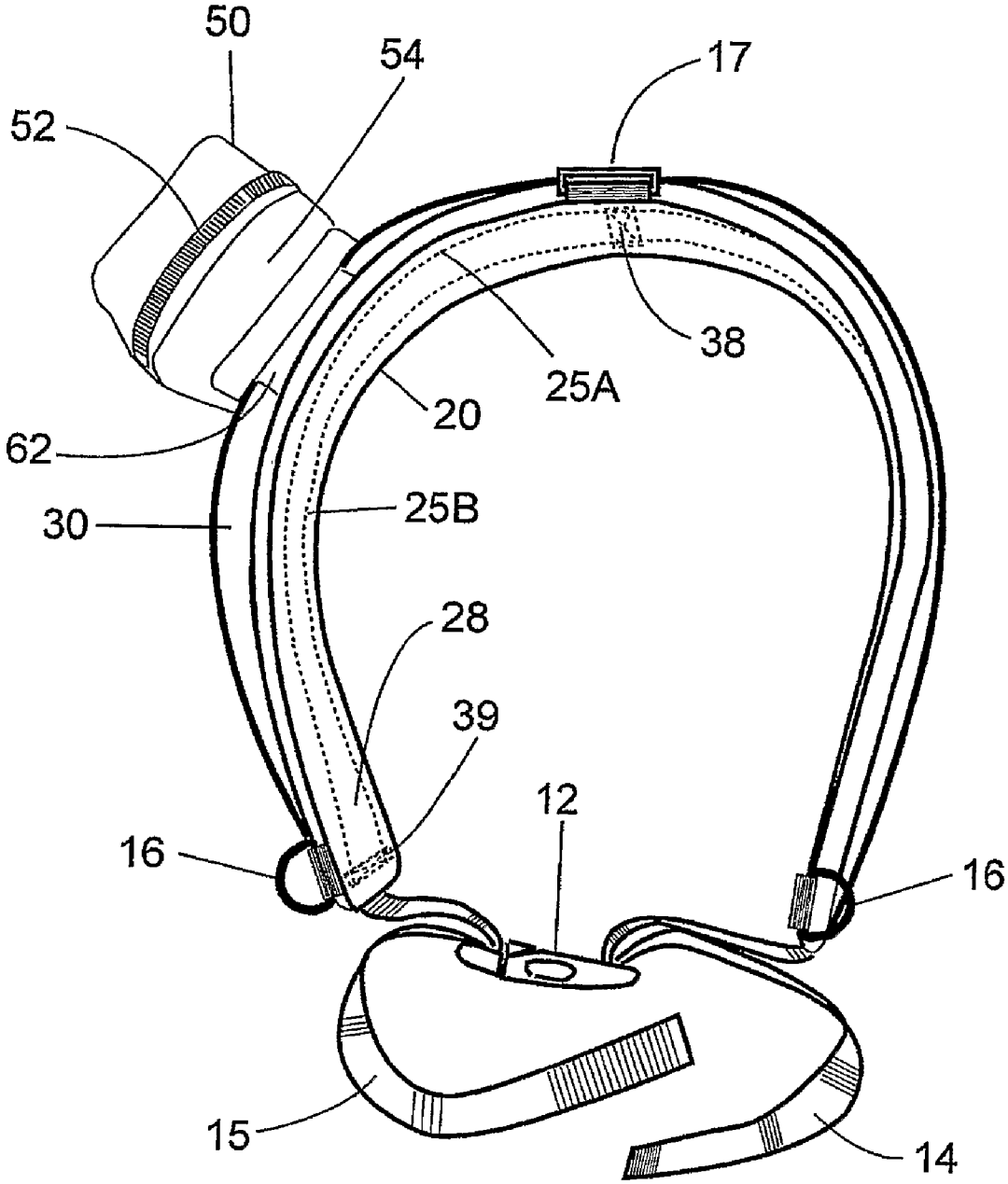
FIG. 3 is a top side view of the waist belt carrier system according to the invention shown in the waist-encircling position of FIG. 1.

(not shown in FIG. 1; see FIGS. 3 and 4) facing toward the body of the person or bearer 2.

Figure 4:
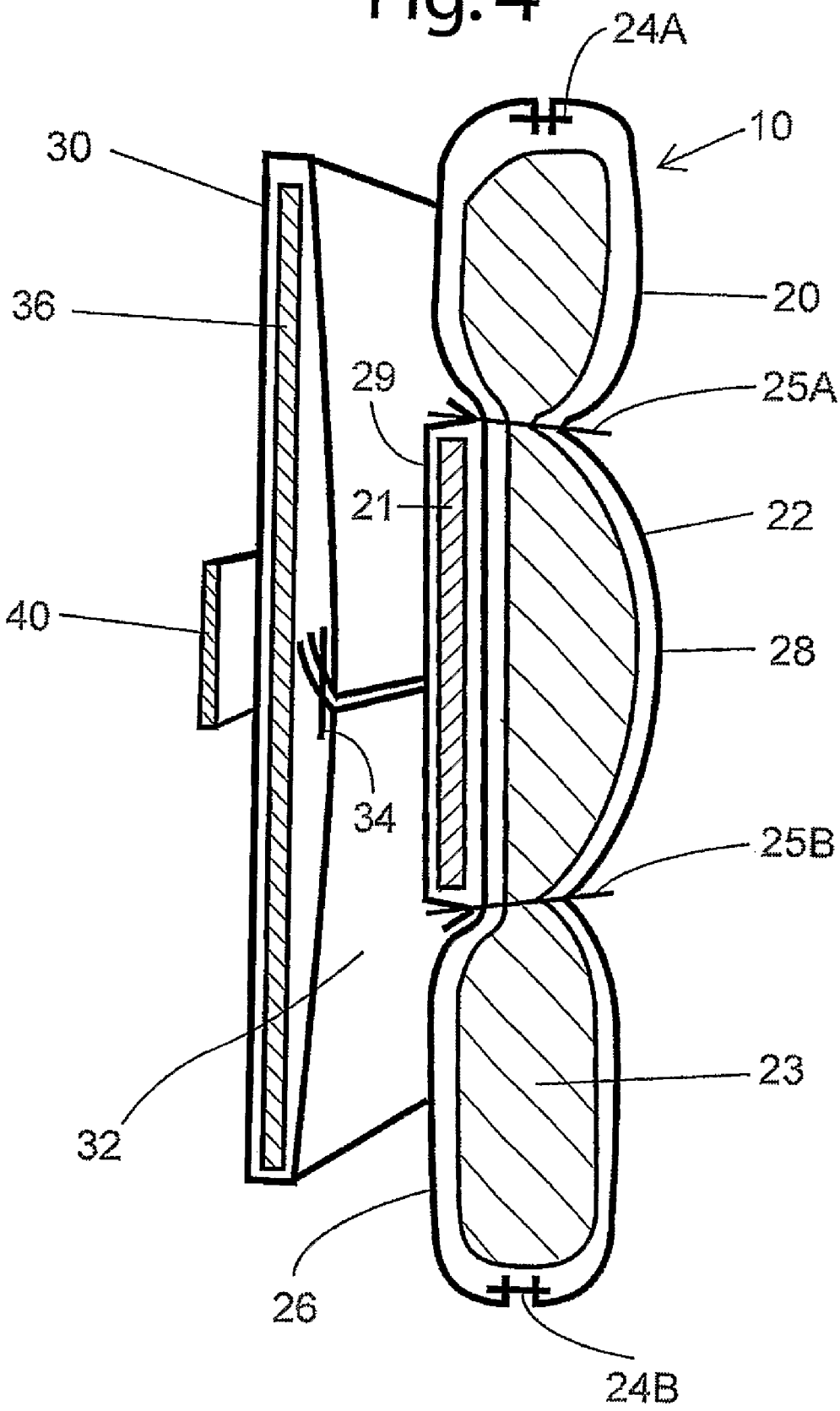
FIG. 4 is a sectional view of the waist belt carrier system according to the invention shown in FIG. 3.

FIG. 4 is an expanded view that shows the construction of the belt 10, minus hardware such as the buckle 12, the D-ring 16, and the rectangular ring 17.

The belt 10 is shown in cross-section in FIG. 4. The body-contacting portion 20 of the belt 10 comprises a fabric tube 22 (preferably made of CORDURA brand fabric or the like) sewn at upper and lower longitudinal stitch lines 24A and 24B so as to surround the foam padding 23. The foam padding 23 is preferably made of EVA (Ethylene Vinyl Acetate) foam.

A stiffener 21, preferably made of PE (polyethylene) board that can be sewn through, for the body-contacting portion 20 of the belt 10, is attached lengthwise to the outside surface 26 of the body-contacting portion 20 by the fabric cover and keeper 29 that is sewn to the fabric tube 22 and the foam padding 23 at the upper and lower transverse stitch lines 25A and 25B. The stitching of the stitch lines 25A and 25B penetrates transversely through the fabric tube 22 and the foam padding 23 and extends lengthwise to the body-contacting portion 20.

The stitch lines 25A and 25B therefore not only secure the stiffener 21 to the fabric tube 22 and the foam padding 23 but also secure the foam padding 23 with respect to the fabric tube 22. The stiffener 21 is flexible when a sideways torque is applied (the torque vector is generally parallel to the plane of the stiffener 21) but resists bending due to vertical torques (the torque vector is generally perpendicular to the plane of the stiffener 21). The stiffener 21 will tend to prevent the belt 10 from sagging when it is worn around the waist of the user 21 and a load in the form of a carrier 50 is applied to the belt 10 as described below.

The opposing ends of the fabric tube 22 are sewn at the X-box stitch connections 39 to first and second webbings 14 and 15 (as well as to the rail 30).

The body-contacting portion 20 of the belt 10 is secured around the body of the person 2 by a buckle 12. The buckle 12 shown in FIG. 1 comprises two mating and detachable pieces 12A and 12B formed from a thermoplastic of a kind well known to the art. The first and second webbings 14 and 15 are threaded through slots in the buckle pieces 12A and 12B, respectively, so that the buckle pieces 12A and 12B may be moved slidably with respect to the webbings 14 and 15 in order to accommodate the girth of the person 2. Such buckles are sold under the FASTEX, DURAFLEX, and other brands. The specific structure and materials of the buckle 12 are not important to this invention. The buckle 12 could have any number of designs and be made of different materials known to the art as long as it is suitable to be a buckle for a belt.

The belt 10 shown in the drawings has two D-rings 16 and a rectangular ring 17 sewn by loops of webbing to the top edge of its body-contacting portion 20. This hardware is provided for optional attachment to a harness (not shown) in order for the shoulders of the person 2 to take part of the weight of the belt 10 and any attached carriers 50.

The body-contacting portion 20 of the belt 10 could be made without the foam padding 23 or could be made of leather or other materials known to the art to which this invention pertains.

The belt 10 is provided with a rail 30 for the purpose of bearing carriers for objects such as the carrier 50 shown in the drawings of this specification. The substantially planar rail 30 is disposed on and parallel to the outside surface 26 of the body-contacting portion 20 of the belt 10. It comprises a PE board stiffener 36 that can be sewn through secured within a fabric tube 32 by a stitch line 34.

Figure 2:
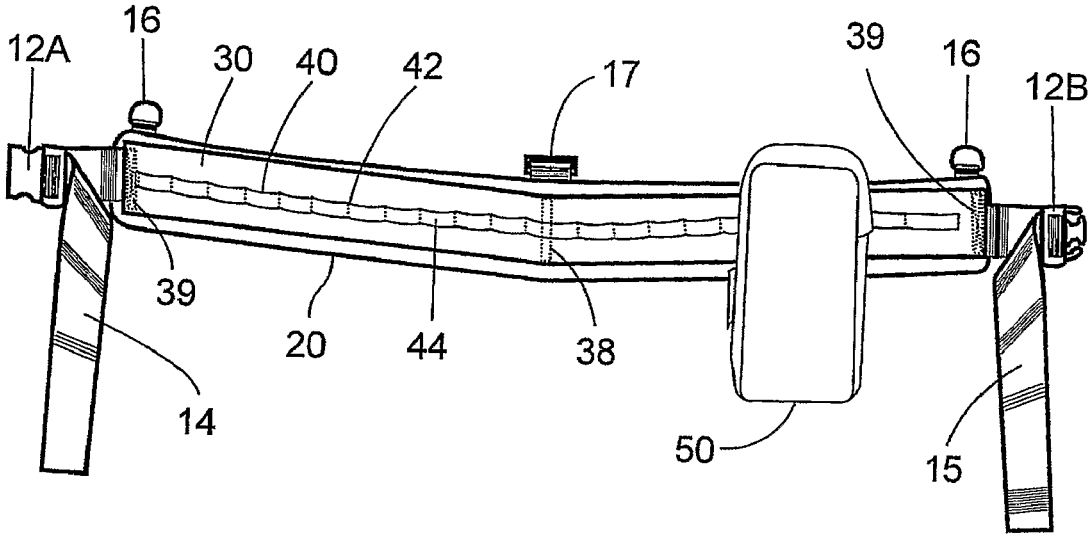
FIG. 2 is a front side view of the preferred embodiment of the waist belt carrier system according to the invention shown in FIG. 1, in which the belt component is stretched out to lie flat in a plane perpendicular to the point of view.
Figure 5:
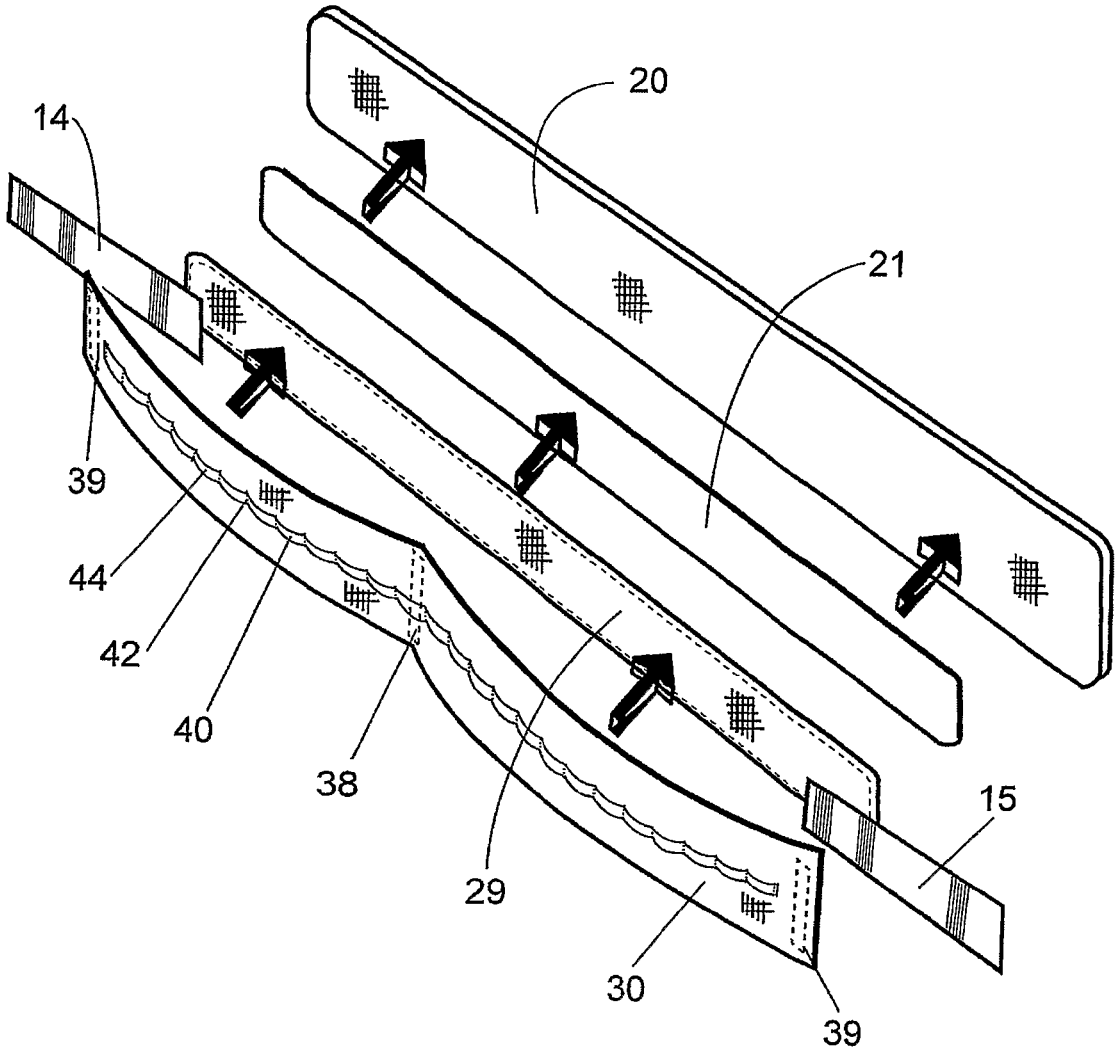
FIG. 5 is an expanded perspective view of the waist belt carrier system according to the invention shown in FIG. 1 showing how the belt component is assembled.

The fabric tube 32 and the PE board stiffener 36 are sewn at opposing ends to the body-contacting portion 20 of the belt 10 by the X-box stitch connections 39. In addition, the fabric tube 32 and the PE board stiffener 36 are sewn at their centers to the body-contacting portion 20 of the belt 10 by the center box stitch connection 38. FIGS. 2 and 5 best show the location of the stitch connections 38 and 39. The rail 30 is therefore divided in right and left portions by the center stitch connection 38. Each of the right and left portions of the rail 30 is not directly attached to the body-contacting portion 20 of the belt except at the stitch connections 38 and 39. This will permit the carrier for objects 50 to be moved laterally with respect to the belt 10, as will be described below, even when the body-contacting portion 20 of the belt 10 is snugly secured around the waist or hips of the person 2, because the sleeve 60 that attaches the carrier 50 to the belt 10 is not trapped or caught between the waist or hips of the person 2 and the body-contacting portion 20.

The stiffener 36 is substantially planar and is flexible to bending due to a sideways torque (the torque vector is generally parallel to the plane of the stiffener 36) but resists bending due to vertical torques (the torque vector is generally perpendicular to the plane of the stiffener 36). The stiffener 36 will tend to prevent the rail 30 from sagging when it is supporting a load in the form of a carrier 50 that is applied to the belt 10 as described below. The rail 30 preferably has a slight curved "V" shape, concave upwards, as is best seen in FIG. 2, in order to further resist sagging.

It will be understood that the rail may have one, two or more portions that are spaced from and not attached to the body-contacting portion 20 of the belt 10, although two such portions of the rail is preferred as shown in the drawings and described herein.

The webbing 40 is sewn by the regularly spaced bar tacks 42 to the outside surface of the rail 30. The spacing of the bar tacks 42 causes the webbing 40 to form loops (or bottomless pockets) 44 spaced along and above the rail 30. Webbing made of nylon or polyester is preferred for webbing 40.

At least one or more loops 44 must be provided on the rail 30 for cooperation with the tab 70 attached to the carrier for articles 50 (see FIGS. 6 and 7 and the discussion below). The specific structure and materials of the loops 44 are not important.

The carrier for articles 50 comprises a body 54 and a sleeve 60. The carrier for articles 50 shown in the drawings is a pouch of a known kind in the photography field having an interior main compartment (not shown) with a top opening secured by a zipper 52. The carrier 50 shown in the drawings is designed to hold photographic articles such as a lens system and the like. The specific structure and form of the body of the carrier for articles 50 is not important to the invention. All that is necessary is that the carrier for articles 50 be suitable for carrying an article or articles that a wearer may wish to carry. The system of the invention could be used with virtually any carrier for articles, such as a holster for a handgun or a canteen.

The carrier for articles 50 is provided with a sleeve 60 made of fabric. The sleeve 60 has a first end 62 sewn or otherwise attached to the carrier for articles 50, as is best seen in FIGS. 6, and 7. A second end 64 of the sleeve 40 detachably connects to a location on the carrier for articles 50 that is spaced from the attachment of the first end 62 so that the sleeve 60 forms a loop sized to enclose the rail 30 as shown in FIGS. 1-3, 6, and 7.

In the preferred embodiment of the invention shown in the drawings the means for attaching the second end 64 of the sleeve 60 to the carrier for articles 50 is by provision of mating hook and loop strips 66 and 68 sewn onto the carrier for articles 50 and onto the sleeve 60 adjacent the second end 64, respectively. Although hook and loop strips are preferred, other means of detachable connection such as snaps and the like are suitable for use in this invention.

Figure 6:
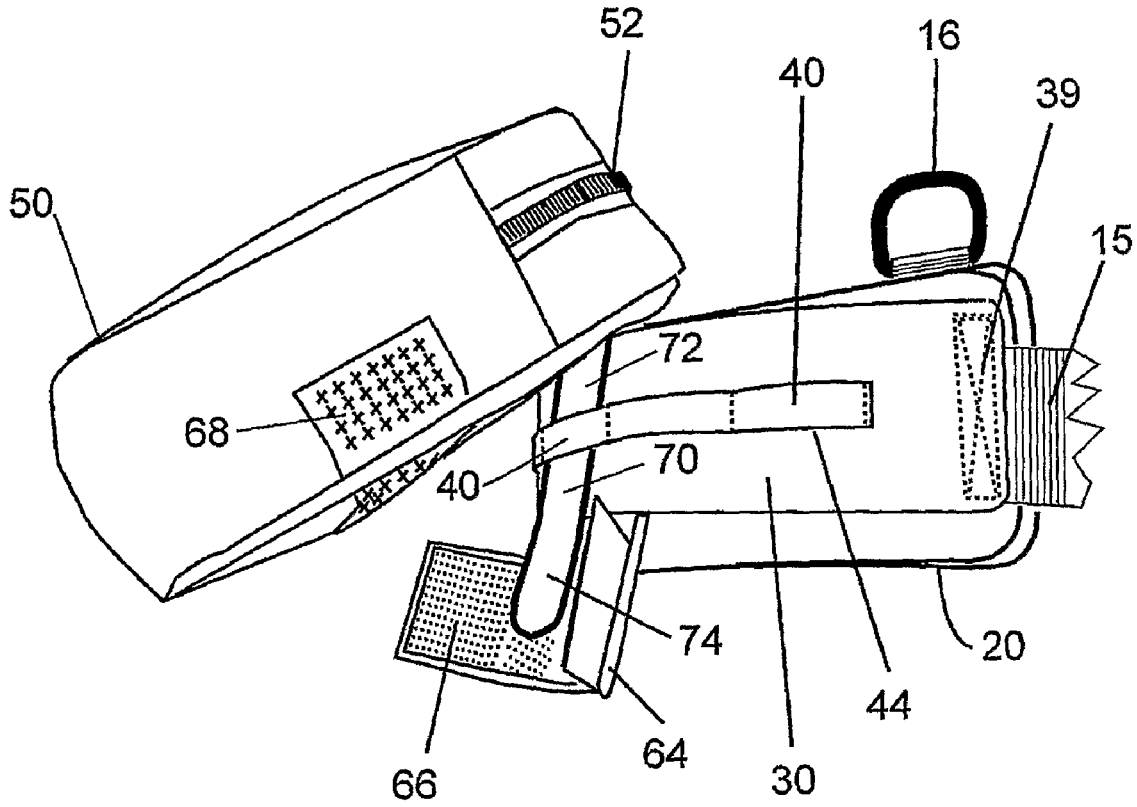
FIG. 6 is a perspective view from the right of the waist belt carrier system according to the invention shown in FIG. 1 demonstrating how the tab of the carrier for articles is inserted into a loop attached to a rail on the belt so as to prevent the carrier for articles from sliding with respect to the belt.
Figure 7:
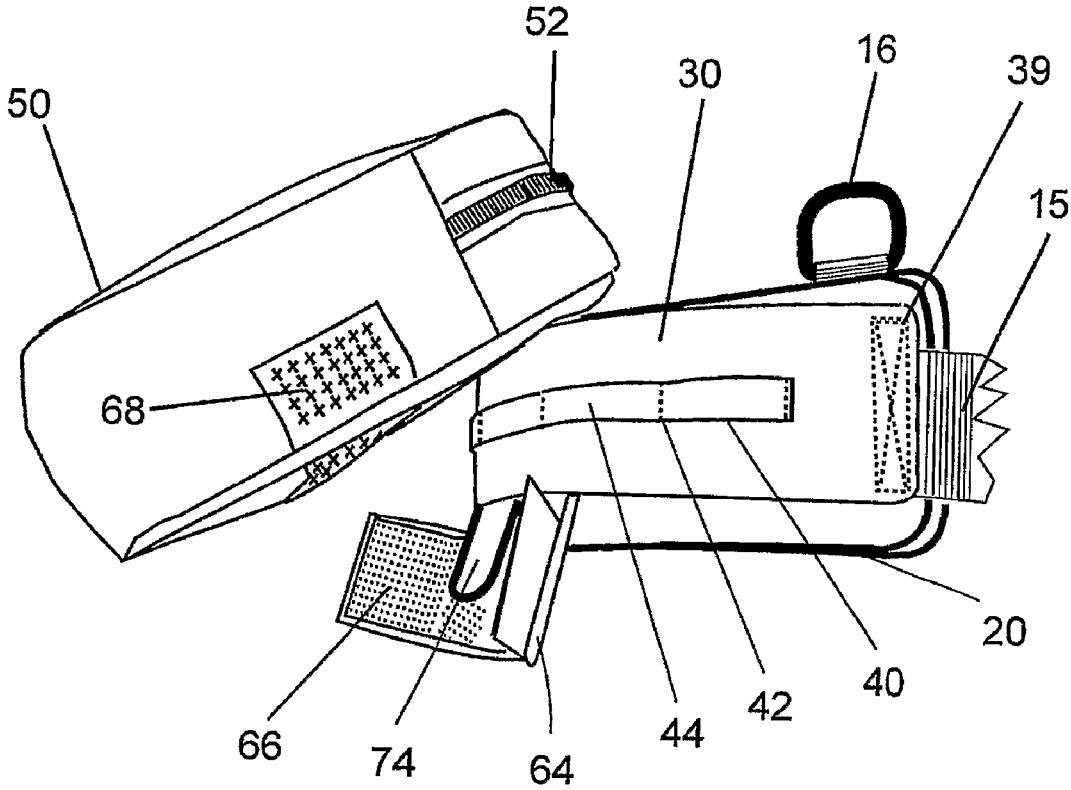
FIG. 7 is a perspective view from the right of the waist belt carrier system according to the invention shown in FIG. 1 demonstrating how the tab of the carrier for objects is inserted into a loop attached to a rail on the belt so as to allow the carrier for articles to slide with respect to the belt.

The means of attachment of the second end 64 of the sleeve 60 to the body 54 of the carrier for articles 50 is illustrated best in FIGS. 6-7. The mating hook and loop strips 66 and 68 may be separated in order to rotate the second end 64 of the sleeve 60 away from the carrier for articles 50 as shown in FIGS. 6-7 so that the carrier for articles 50 can be attached or detached from the rail 30.

The specific structure and materials of the sleeve 60 is not important as long as the sleeve 60 can be detachably secured at one of its ends to the carrier 50.

As may be seen in FIGS. 6-7, a tab 70 is attached to the carrier 50 by being sewn at a first end 72 between the carrier 50 and the first end 62 of the sleeve 60. The tab 70 is preferably made of a thin and stiff material such as polyethylene (PE) board that may be sewn through. The second end 74 of the tab 70 is not sewn or otherwise permanently attached to anything so that it may be inserted through one of the loops 44 as shown in FIG. 6.

The tab 70 lies between the carrier for articles 50 and the sleeve 60 when the second end 64 of the sleeve 60 is attached by the mating hook and loop strips 66 and 68 to the carrier for articles 50 and thus will not be observed when the carrier for articles 50 is in that condition as shown in FIGS. 1 and 2. The tab 70 will be easily observable when the second end 64 of the sleeve 60 is detached from the carrier for articles 50 as shown in FIGS. 6-7.

The first end 72 of the tab 70 is broadened in the form of the cross-bar of a "T" to provide a broader space for sewing in the attachment of that end to the carrier for articles 50. This will help prevent rotation of the second end 74 of the tab 70 from side to side along the plane of the tab 70 and will anchor the tab 70 more securely to the carrier 50 because of the greater length of the stitch line.

The second end 74 of the tab 70 is rounded to facilitate insertion of the second end 74 through one of the loops 44 as shown in FIG. 6. As mentioned, the tab 70 is preferably made of a stiff but flexible material such as PE board, and this will facilitate the insertion of the second end 74 through one of the loops 44.

Preferably the tab 70 is long enough that the second end 74 will be in contact with the hook and loop strips 66 and 68 when the second end 64 of the sleeve 60 is attached to the body 54 of the carrier for articles 35 but will not extend below or beyond the sleeve 60. This positioning and length of the tab 70 is indicated in FIGS. 6-7. It has been found that this configuration is preferred in order to further prevent twisting or rotation of the tab 70 with respect to its attachment to the body 54 of the carrier for articles 50 when the carrier for articles 50 is subjected to forces that would tend to twist the carrier for articles 50 with respect to the belt 10 because the second or free end 74 of the tab 70 is anchored with respect to the body 54 of the carrier for articles 50 by being trapped between the hook and loop strips 66 and 68.

The carrier for articles 50 may be attached to the belt 10 in one or another of two modes. FIGS. 6 and 7 shows a first mode of attachment in which the carrier for articles 50 will be fixed with respect to the belt 10 because the tab 70 is inserted through one of the loops 44 when the sleeve 60 is wrapped around the rail 30. In this mode the carrier for articles 50 cannot slide or move along the rail 30 and thus the belt 10 and therefore will remain in the same position with respect to the body of the person 2 as long as the belt 10 remains in the same relative position with respect to the body of the person 2. This is the mode to use if the person 2 has found a preferred position for the carrier for articles 50 or simply wishes for the carrier for articles 50 to not shift while the bearer is moving.

The other or second mode of attachment is shown in FIG. 7. In this mode the tab 70 is not inserted through one of the loops 44 when the sleeve 60 is wrapped around the rail 30. In this mode the carrier for articles 50 can slide or move along the belt. The bearer can slide or move the carrier for articles 50 on the belt as needed for use and/or comfort. This is the mode to use if the bearer wishes to adjust the position of the carrier for articles 50 without removing the carrier for articles 50 from the rail 30. The bearer, for example, may want to bear the carrier for articles 50 in one position on the belt for reasons of comfort or convenience when moving, sitting or standing but would like to quickly move the carrier for articles 50 to a position for more ready access to the articles contained in the carrier 50.

An aspect of the invention disclosed herein comprises a system for carrying articles from a belt worn on the body of a person or other animate bearer. The system may comprise a belt or elongated member with a substantially planar rail borne on the outside surface of the belt and a carrier for articles attached to the rail by a sleeve sewn to the body of the carrier. The carrier may be free to slide along the rail or may be secured at least temporarily to the rail. The carrier thereby can be moved along the rail when worn on the belt so that the bearer can place the carrier in a more comfortable or useful position with respect to the body of the bearer and secure it in that position at least temporarily.

While the invention has been described in conjunction with the preferred embodiment, it will be understood that it is not intended to limit the invention to this embodiment. On the contrary, the invention is intended to cover alternatives, modifications and equivalents that may be included within the spirit and scope of the invention as defined by the appended claims.

What is claimed is:

1. A carrier system, comprising:

a belt comprising an elongated member to be worn by an animate bearer such as a human being and having an outside surface facing away from the bearer's body and an inside surface facing toward the body of the bearer, and a substantially planar rail comprising a flexible and planar stiffener element, the rail having a center and two spaced apart ends, each end of the rail being attached to the outside surface of the elongated member, the center of the rail being attached to a center of the elongated member so that the rail has right and left portions spaced from the outside surface of the elongated member whereby the rail is attached to and supported by the outside surface of the elongated member and spaced from the outside surface of the elongated member at points where the rail is not attached to the elongated member;

wherein the rail is shaped like a "V" in which the right and left portions of the rail are joined at a generally obtuse angle and the stiffener element extends between points where the rail is attached to the elongated member, whereby a carrier for an article may be detachably secured to the rail between the points of attachment and the carrier may be slid along the rail, and the stiffener element tends to prevent the rail from sagging due to the weight of the carrier.

2. The carrier system according to claim 1 wherein the elongated member further comprises a substantially planar stiffener.

3. The carrier system according to claim 1 wherein the rail is concave upwards.

4. The carrier system according to claim 1 wherein the elongated member has two spaced-apart ends and the belt further comprises a buckle for joining the two ends of the elongated member.

5. The carrier system according to claim 1 further comprising at least one carrier for an article, the carrier comprising:

a body and a sleeve connected to the body of the carrier for detachably securing the carrier to the rail.

6. The carrier system according to claim 5 wherein the sleeve further comprises a first end attached to the body of the carrier and a second end with means for detachable attachment to the body of the carrier, the first end and the second end of the sleeve being spaced apart at their respective places of attachment to the body of the carrier so that the second end of the sleeve can be folded over the rail and attached to the body of the carrier.

7. The carrier system according to claim 6 wherein the carrier further comprises:

a tab made of stiff material having a first end attached to the body of the carrier at or near the junction of the first end of the sleeve to the body of the carrier and a second end remaining unattached, the tab having an axis generally aligned with the sleeve, wherein the second end of the tab is adapted to be capable of being inserted through a loop attached to the rail when the sleeve is folded over the rail for attachment of the carrier to the rail and thereby fixing the carrier with respect to the rail so that the carrier substantially may not be slid along the rail whereas if the tab is not inserted into the loop when the sleeve is folded over the rail the carrier is not substantially fixed with respect to the rail and may be slid along the rail.

8. The carrier system according to claim 7 in which the tab is long enough that the second end of the tab is adjacent the means of detachable attachment of the second end of the sleeve when the carrier for articles is supported by the rail.

9. A carrier system comprising:

a belt comprising an elongated member to be worn by an animate bearer such as a human being and having an outside surface facing away from the bearer's body and an inside surface facing toward the body of the bearer, and a substantially planar rail having two spaced apart ends and comprising a flexible and planar stiffener element extending from one end of the rail to the other, the rail being attached to and supported by the elongated member at its outside surface and spaced from the outside surface of the member at points where the rail is not attached to the elongated member, the rail having at least one loop attached to it, whereby a carrier for an article may be detachably secured to the rail between the points of attachment and the carrier may be slid along the rail, and the stiffener element tends to prevent the rail from sagging due to the weight of the carrier;

at least one carrier for an article, the carrier comprising:

a body;

a sleeve connected to the body of the carrier for detachably securing the carrier to the rail; and a tab made of stiff material having a first end attached to the body of the carrier at or near the junction of the first end of the sleeve to the body of the carrier and a second end remaining unattached, the tab having an axis generally aligned with the sleeve, wherein the second end of the tab is adapted to be capable of being inserted through a loop attached to the rail when the sleeve is folded over the rail for attachment of the carrier to the rail and thereby fixing the carrier with respect to the rail so that the carrier substantially may not be slid along the rail whereas if the tab is not inserted into the loop when the sleeve is folded over the rail the carrier is not substantially fixed with respect to the rail and may be slid along the rail.

10. The carrier system according to claim 9 in which the tab is long enough that the second end of the tab is adjacent the means of detachable attachment of the second end of the sleeve when the carrier for articles is supported by the rail.

11. A method of carrying articles, comprising: providing a belt comprising an elongated member to be worn by an animate bearer such as a human being and having an outside surface facing away from the bearer's body and an inside surface facing toward the body of the bearer, the belt comprising a substantially planar rail comprising a flexible and planar stiffener element, the rail having a center and two spaced apart ends, each end of the rail being attached to the outside surface of the elongated member, the center of the rail being attached to a center of the elongated member so that the rail has right and left portions spaced from the outside surface of the elongated member whereby the rail is attached to and supported by the outside surface of the elongated member and spaced from the outside surface of the elongated member at points where the rail is not attached to the elongated member, the rail being shaped like a "V" in which the right and left portions of the rail are joined at a generally obtuse angle concave upward, the-stiffener element extending between points where the rail is attached to the elongated member, and detachably securing a carrier for an article to the rail between the points of attachment of the rail, whereby the stiffener element tends to prevent the rail from sagging due to the weight of the carrier.

12. The method of carrying articles according to claim 11, further comprising the step of securing the carrier to the rail wherein the carrier may either be slid along the rail or prevented from sliding along the rail.

* * * * *